US010041349B2

(12) United States Patent
Webb et al.

(10) Patent No.: US 10,041,349 B2
(45) Date of Patent: Aug. 7, 2018

(54) GUIDE SYSTEM

(71) Applicant: Technological Resources Pty. Limited, Melbourne, Victoria (AU)

(72) Inventors: Rocky Lynn Webb, North Bay (CA); Fredric Christopher Delabbio, Samford (AU)

(73) Assignee: Technological Resources Pty. Limited, Melbourne (AU)

( * ) Notice: Subject to any disclaimer, the term of this patent is extended or adjusted under 35 U.S.C. 154(b) by 314 days.

(21) Appl. No.: 14/895,374

(22) PCT Filed: Jun. 6, 2014

(86) PCT No.: PCT/AU2014/000593
§ 371 (c)(1),
(2) Date: Dec. 2, 2015

(87) PCT Pub. No.: WO2014/194370
PCT Pub. Date: Dec. 11, 2014

(65) Prior Publication Data

US 2016/0115788 A1 Apr. 28, 2016

(30) Foreign Application Priority Data

Jun. 7, 2013 (AU) ..... 2013902067

(51) Int. Cl.

| | |
|---|---|
| ***E21D 7/02*** | (2006.01) |
| ***E21D 1/03*** | (2006.01) |
| ***E21F 13/00*** | (2006.01) |
| ***B66B 9/16*** | (2006.01) |
| ***B66B 7/02*** | (2006.01) |
| *B66B 19/00* | (2006.01) |

(52) U.S. Cl.
CPC ..... *E21D 7/02* (2013.01); *B66B 7/02* (2013.01); *B66B 9/16* (2013.01); *E21D 1/03* (2013.01); *E21F 13/00* (2013.01); *B66B 19/00* (2013.01)

(58) Field of Classification Search
CPC .. E21D 7/02; E21D 1/03; E21D 11/40; B66B 11/00; B66B 15/00; B66B 17/00; B66B 19/00; E21F 13/00
See application file for complete search history.

(56) References Cited

U.S. PATENT DOCUMENTS 2,606,679 A * 8/1952 Cryderman ..... E21D 1/04 414/625
3,185,226 A * 5/1965 Robbins ..... E21D 1/03 175/102

(Continued)

FOREIGN PATENT DOCUMENTS

CA 2543511 C * 4/2010 ..... E21D 1/03
CA 2765758 A1 * 1/2011 ..... E21D 1/03

(Continued)

OTHER PUBLICATIONS

Oct. 9, 2014—(WO) International Search Report—PCT/AU2014/000593.

*Primary Examiner* — Kaitlin S Joerger
(74) *Attorney, Agent, or Firm* — Banner & Witcoff, Ltd.

(57) ABSTRACT

A variable length guide system for guiding a conveyance along a mineshaft, the variable length guide system extending downwardly from a work stage and being extendable or retractable to accommodate changes in distance between the work stage and a lower region of a mineshaft.

19 Claims, 3 Drawing Sheets

(56) References Cited

U.S. PATENT DOCUMENTS

| | | | | | |
|---|---|---|---|---|---|
| 3,965,995 | A * | 6/1976 | Sugden | ..... | E21D 1/03 175/102 |
| 7,293,615 | B2 * | 11/2007 | Medd | ..... | E21D 1/03 175/86 |
| 2009/0039695 | A1 | 2/2009 | Antoline et al. | | |

FOREIGN PATENT DOCUMENTS

| | | | | | |
|---|---|---|---|---|---|
| CA | 2765758 | C * | 4/2013 | ..... | E21D 1/03 |
| WO | 2005/049966 | A1 | 6/2005 | | |
| WO | 2011/000037 | A1 | 1/2011 | | |
| WO | WO-2011000037 | A1 * | 1/2011 | ..... | E21D 1/03 |
| WO | WO-2014078878 | A1 * | 5/2014 | ..... | E21D 1/03 |

* cited by examiner

GUIDE SYSTEM

CROSS-REFERENCE TO RELATED APPLICATIONS

The present application is a U.S. National Phase filing of International Application No. PCT/AU2014/000593, filed on Jun. 6, 2014, designating the United States of America and claiming priority to Australian Patent Application No. 2013902067 filed Jun. 7, 2013, and the present application claims priority to and the benefit of both the above-identified applications, which are incorporated by reference herein in their entireties.

FIELD OF THE PRESENT DISCLOSURE

The present disclosure relates to guiding movement of a conveyance up and down a mineshaft. It has particular but not exclusive application to guiding conveyances that convey materials and personnel up/down a mineshaft between a work stage and a lower region of the mineshaft (e.g. in the vicinity of an excavator head).

BACKGROUND

Traditional shaft sinking operations are carried out by drilling and blasting to excavate materials from a hole and removing the excavated material using a mucking system. The mucking system picks up the excavated material and deposits that material in buckets or kibbles that are hoisted to the surface on cables or fixed guides running to headgear incorporating a hoist at the top of the mineshaft. The mineshaft may extend downwardly from the earth surface, or may be a winze.

Bucket or kibble systems are useful in drilling and blasting shaft sinking processes since progress of the shaft is made in discrete/incremental steps. For example, a 3 to 4 (or greater) meter depth is drilled and blasted in the base of a mineshaft, a mucking system and operator are then lowered to the blasted rock and buckets or kibbles are lowered to the shaft bottom to be loaded by the mucking system. The buckets or kibbles are lowered to the shaft bottom on ropes or cables. While ropes or cables can be used to dictate the general direction of travel of the buckets or kibbles (i.e. upward or downward), they do not 'guide' the buckets or kibbles as lateral movement and rotation are still possible.

Once all of the blasted rock has been removed, the operator, mucking machines and buckets or kibbles are removed and the drill and blast process repeats.

More recently there have been proposals to increase the speed at which sinking can progress by using earth boring machinery. International patent publication number WO 2011/000037A1 discloses such a proposal for sinking a mineshaft.

Unless context specifies otherwise, the term "guide" as used herein refers to a member along which a conveyance travels down a mineshaft, and that resists or prevents rotation of the conveyance and lateral movements of the conveyance relative to the mineshaft. Such a "guide" provides no motive or drive force to cause movement of the conveyance.

SUMMARY OF THE PRESENT DISCLOSURE

The present disclosure provides a variable length guide system for guiding a conveyance along a mineshaft, the variable length guide system extending downwardly from a work stage and being extendable or retractable to accommodate changes in distance between the work stage and a lower region of a mineshaft.

The lower region may be a region below the work stage, between the work stage and the cutting head.

The lower region may be a region below the work stage, between the work stage and the bottom of the mineshaft.

The variable length guide system may extend from the work stage in the direction of a shaft forming apparatus. The shaft forming apparatus may comprise a rotary cutting head. The shaft forming apparatus may be a shaft forming apparatus as described in WO2011/000037A1.

The variable length guide system may extend with movements of the shaft forming apparatus away from the work stage, and retract with movements of the work stage towards the shaft forming apparatus.

The variable length guide system may extend to the shaft forming apparatus.

The variable length guide system may be connected to the shaft forming apparatus and the work stage.

The variable length guide system may comprise a first member attached to the work stage and a second member attached to the shaft forming apparatus, wherein the first member and second member are slidably engaged and wherein relative sliding movement of the second member relative to the first member results in extension and retraction of the variable length guide system.

Downward movement of the shaft forming apparatus may slidably extend the second member from the first member.

Downward movement of the shaft forming apparatus may slidably retract the second member into the first member.

The variable length guide system may comprise a telescopic guide assembly.

The telescopic guide assembly may comprise a plurality of concentrically disposed members.

There may be two such concentrically disposed members.

One of the concentrically disposed members may be attached to the work stage.

One of the concentrically disposed members may be attached to the shaft forming apparatus.

The concentrically disposed member attached to the shaft forming apparatus may fit concentrically within the concentrically disposed member attached to the work stage.

The concentrically disposed members may have the same cross-section shape.

The concentrically disposed members may each have a square or rectangular cross-section.

The concentrically disposed members may each comprise a rail.

The concentrically disposed members may each comprise a pole.

The concentrically disposed members may each comprise a rod.

The concentrically disposed members may each comprise a shaft.

The concentrically disposed members may each have a square cross-section.

The concentrically disposed members may each have a rectangular cross-section.

The concentrically disposed members may each have a round cross-section.

The variable length guide system may comprise a normally flexible member extending between the work stage and shaft forming apparatus, the normally flexible member being held under sufficient tension to provide a substantially rigid guide along which the conveyance travels between the work stage and lower region.

The normally flexible member may comprise a rope.

The normally flexible member may comprise a cable.

The normally flexible member may be wound onto a drum and is held under tension by rotation of the drum.

The normally flexible member may be attached to one of the work stage and shaft forming apparatus, extend towards the other of the work stage and shaft forming apparatus, pass around a sheave and terminate at a counterweight for maintaining tension in the normally flexible member.

The variable length guide system may comprise one or more ropes.

Each rope may comprise a tensioned, wire rope.

Each rope may wind onto a drum located on the work stage, by which drum the respective rope is extended and retracted.

Each rope may wind onto a drum located in the lower region of the mineshaft, by which drum the respective rope is extended and retracted.

Each rope may extend from the work stage, around a sheave located in the lower region of the mineshaft and back up to the work stage.

The drum may be located on the shaft-forming apparatus.

The rope may comprise a steel rope.

The variable length guide system may rigidly extend in fixed direction downwardly from the work stage.

The variable length guide system may be sufficiently rigid so as to substantially resist rotation and lateral movement of the conveyance during travel along the variable length guide system.

A part of the variable length guide system may be rigidly connected to the work stage.

The part of the variable length guide system rigidly connected to the work stage, and the work stage itself, may together comprise a single rigid structure.

The mineshaft may extend to an earth surface region.

The mineshaft may comprise a winze.

A fixed guide system may extend into the work stage, upwardly from the variable length guide system.

The variable length guide system may be in alignment with the fixed guide system.

The variable length guide system may be offset from, but extend in a parallel direction to, the fixed guide system.

The fixed guide system may be fixed to the work stage.

The variable length guide system may slidably engage the fixed guide system.

The variable length guide system may telescopically interact with the fixed guide system.

The variable length guide system may telescopically receive a lower end of the fixed guide system.

As the variable length guide system retracts, the lower end of the fixed guide system may retract into the upper end of the variable length guide system.

An upper variable length guide system may extend upwardly from the fixed guide system to an upper region of the mineshaft.

The upper variable length guide system may comprise a stage support assembly.

The variable length guide system may be extendable without a corresponding extension and/or retraction of the upper variable length guide system.

The variable length guide system may be retractable as the upper variable length guide system extends.

The present disclosure also provides a mineshaft conveyance system comprising a variable length guide system as described above, and a hoist system for lifting and/or lowering the conveyance along the guide system Also disclosed herein is a variable length guide system constituting part of a guide system for guiding a conveyance during lifting and/or lowering of the conveyance in a mineshaft, the system comprising:

an intermediate fixed length guide section fixable to the work stage; and a variable length upper guide section extending from the intermediate section to accommodate changes in distance between the intermediate section and an upper region of the mineshaft.

The variable length guide system may be extendable without a corresponding extension and/or retraction of the upper guide section.

The variable length guide system may retract as the upper guide section extends. The upper guide section may in fact be extendable with downward movements of the intermediate section. The variable length guide system may extend between the intermediate section and a shaft forming apparatus and extend with movements of the shaft forming apparatus away from the intermediate section, and retract with movement of the intermediate section towards the shaft forming apparatus.

In some embodiments, the upper guide section extends from ground level down to a work stage where the upper guide section meets the intermediate section. The intermediate section is fixed to the work stage and extends through the work stage to the variable length guide system. The variable length guide system extends from the work stage to a shaft forming apparatus, extending as the shaft is formed and retracting as the work stage (and therewith the intermediate section) advances down the mineshaft towards the shaft forming apparatus.

The upper guide section and intermediate section may meet at a transition region, and the conveyance may comprise a head section and a base section, the transition region being adapted to halt downward travel of the head section whilst permitting the base section to continue downward travel along the section.

It will be appreciated that the variable length guide system, or variable length lower guide section, can be provided without also providing the variable length upper guide section and intermediate fixed length guide section.

The present system may be designed for use in a substantially vertical mineshaft.

The present disclosure also extends to a mineshaft conveyance system comprising a variable length guide system as set out above or a guide system as set out above, and a hoist system for lifting and/or lowering the conveyance along the guide system.

In the design of a "guide" as used in conjunction with the present disclosure, it may be considered that a guide is to be sufficiently strong and rigid to resist any lateral and rotational forces resulting from impact loads and rotational forces of a fully loaded conveyance traveling up or down the shaft at maximum design speed of the conveyance. This will ensure the conveyance maintains safe clearance from any obstruction or other conveyances it may travel past over the length of the guide system.

There will, in general, be some 'tolerance' in the permissible degree of rotation or lateral movement that depends on clearances between, for example:

other conveyances concurrently running along the shaft.

the conveyance and the closest fixed object (obstruction) in the shaft—such a fixed object may be, for example, a pipe or shaft set.

the conveyance and opening at various points in the work stage through which the conveyance passes during upward or downward travel.

Guide systems may be designed and maintained to very tight tolerances, such as +/−4 mm in both directions (i.e. in plan view +/−4 mm North/South AND +/−4 mm East/West) for high speed conveyances over the length of a mineshaft.

Design tolerances may need to be tighter than the permissible maximum tolerance, to accommodate errors in installation (alignment), and wear of components (guides or conveyance bushings).

Tolerances may be tighter in areas where obstructions are present, such as in the work stage, and may be looser in areas where fewer or no obstructions are present, such as in the open shaft between the work stage and shaft-forming apparatus.

BRIEF DESCRIPTION OF THE DRAWINGS

In order that the system of the present disclosure may be more fully explained one particular embodiment will be described in detail with reference to the accompanying drawings in which.

DETAILED DESCRIPTION OF THE PREFERRED EMBODIMENT

Figure 1:
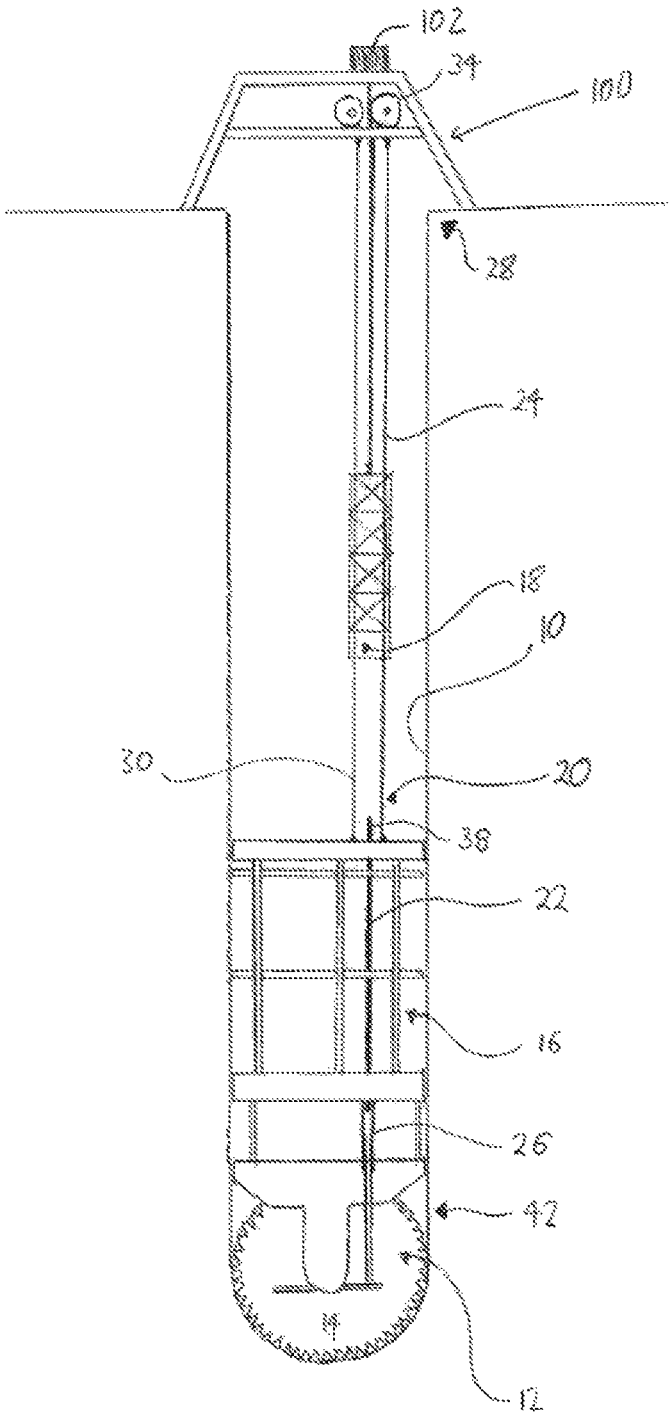
FIG. 1 is a side schematic view of a mineshaft-boring machine employing a guide system in accordance with the present disclosure.

FIG. 1 shows a substantially vertical mineshaft 10 being developed by a mineshaft-boring, or shaft-sinking, machine 12. The machine 12 comprises a shaft forming apparatus, namely cutting head 14, for sinking the mineshaft, and a work stage 16 on which personnel line the shaft as it is developed. Such a mineshaft-boring machine is described in WO2011/000037 in which a rotary cutting head is mounted to a lower end of a main machine frame and is equipped with cutters for sinking the shaft. Cuttings from the cutting head are passed upwardly to a discharge/loading station in the work stage and are transferred to skips for ascending the shaft to the surface.

The work stage 16 is suspended above the mineshaft-boring machine 12. The work stage 16 is moveable down the mineshaft 10 independently of downward movements of the mineshaft-boring machine 12.

Personnel and materials are transported to the work stage in a conveyance 18. The conveyance 18 includes a base section, presently cage 18", having a square cross-section. The square cage 18" is fully enclosed to prevent material and human limbs from extending from the cage 18". To move the conveyance 18, the mineshaft 10 is equipped with a mineshaft conveyance system 100. The mineshaft conveyance system 100 comprises a guide system 20 as discussed below, and a hoist system 102 for lifting and lowering the conveyance 18 along the guide system 20.

The hoist system 102 lifts and lowers the conveyance 18 over the full length of the guide system 20. In other words, the hoist system 102 provides the motive force for controllably lifting and lowering the conveyance 18. The hoist system is attached to the top of the conveyance 18 in a known manner.

The guide system 20 does not provide any motive force to lift or lower the conveyance 18. The guide system 20 guides movement of the conveyance 18, ensuring that the conveyance 18 does not rotate or move laterally during ascent/descent along the mineshaft 10. By removing or reducing lateral movements of the conveyance 18, the likelihood of collisions between the conveyance 18 and walls of the mineshaft 10, or other equipment, is substantially reduced.

The conveyance 18 travels or runs along a guide system 20 for guiding lifting and/or lowering of the conveyance 18 in the mineshaft 10. The guide system 20 comprises an intermediate fixed length guide section, embodied by fixed guides 22, a variable length upper guide section, embodied by stage support assembly 24, and a variable length guide system, embodied by telescopic guide assembly 26.

Using the guide system 20, a conveyance 18 can be guided along the full extent of travel up and down a mineshaft. In this sense, the term 'guide' means that the path of the conveyance is substantially fixed so that lateral movements of the conveyance 18, and rotation of the conveyance 18, are substantially prevented.

The fixed guides 22 are fixed to the work stage 16 so extension/retraction of the stage support assembly 24 and telescopic guide assembly 26 is generally described with reference to movements of the work stage 16 or of components (e.g. the cutting head 14) relative to the work stage 16.

The stage support assembly 24 extends upwardly from the fixed guides 22 to accommodate changes in distance between the fixed guides 22 and an upper region 28 of the mineshaft 10. Thus the conveyance 18 can travel along the stage support assembly 24 as shown in FIG. 1, between ground level (e.g. an above ground loading/discharge region) and the work stage 16. It will be appreciated that the mineshaft 10 may comprise a winze, in which case the conveyance 18 would travel along the stage support assembly 24 between an upper region of the winze and the work stage 16.

As the mineshaft 10 is extended the distance from the upper region 28 to the work stage 16 (i.e. the distance from the upper region 28 to the fixed guides 22) increases. To this end the stage support assembly 24 has variable length to accommodate variation in the distance between the upper region 28 and work stage 16 or fixed guides 22. In particular, the stage support assembly 24 is extendable to facilitate lengthening of the distance between the upper region 28 and work stage 16. It may similarly be desirable to lift the work stage 16 and so the stage support assembly 24 is also retractable.

Figure 2:
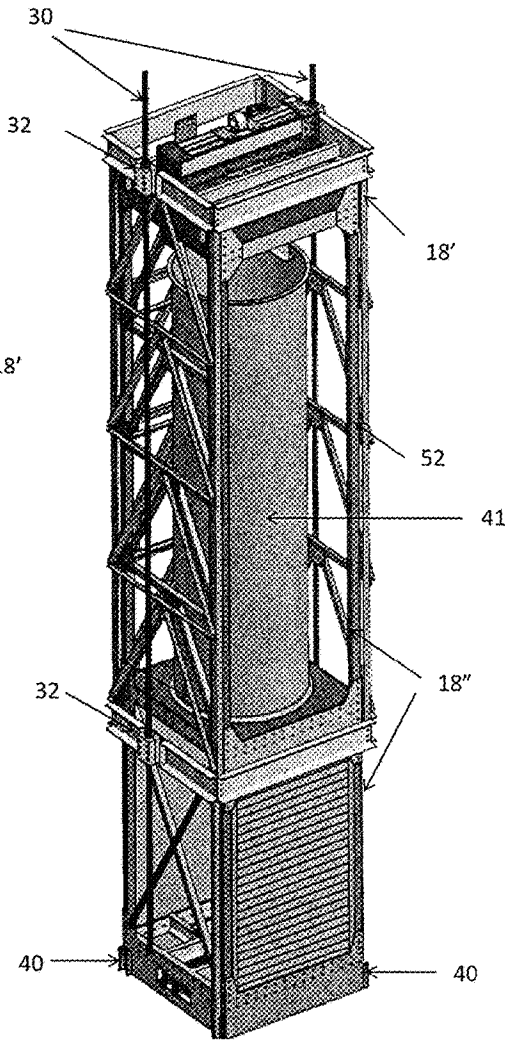
FIG. 2 is a side perspective view of a conveyance, including head and base sections, in engagement with the upper guide section (stage ropes) of the guide system.

The stage support assembly 24 comprises a pair of stage ropes 30 that extend up the barrel of the mineshaft 10, as shown in FIG. 2. It will be appreciated that any number of ropes or alternative guide means may be used as desired, and that the ropes may be fabricated from any appropriate material (typically steel). For example, the stage support assembly 24 may constitute wire ropes or cables, wound steel pipe or coiled tube, steel straps, chains and so forth. Any other elongated pliable material or structure that can be wound in and wound out may be used as the stage support assembly 24.

The stage ropes 30 run in running sleeves 32 provided on the conveyance 18 to guide movement of the conveyance 18 between the upper region 28 of the mineshaft 10 and the work stage 16.

With further reference to FIG. 1, the stage ropes 30 are received on sheaves or cable drums 34 that unwind and wind to extend and retract the stage ropes 30. The sheaves 34 are mounted in a head frame 36 extending over the open upper end of the mineshaft 10 so that the ropes 30 extend directly from the sheaves 34 down the mineshaft 10.

The sheaves 34 maintain sufficient tension in the stage ropes 30 to ensure that the conveyance 18 can travel up/down the variable length upper guide section 24 without significant rotation and/or lateral deflection. In other words, the stage ropes 30 maintain the orientation of the conveyance 18 as it ascends/descends the mineshaft 10 in the region upwardly of the work stage 16. By preventing rotation and lateral movements of the conveyance 18, conveyances 18 having a square or rectangular cross-section may be used, since the risk of the corners of the conveyance 18 catching against the work stage 16 is removed. The stage support assembly 24—in the present embodiment, the stage ropes 30—support the weight of the work stage 16. Thus the stage support assembly 24 is under considerable tension (upwards of 250 t). When under tension, the stage support assembly 24 is, in effect, a substantially rigid member along which the conveyance 18 travels. Thus the stage support assembly 24 serves to control the path of travel of the head section or crosshead 18', and thereby guide the conveyance 18, along the mineshaft such that the conveyance 18 experiences substantially no lateral movement of rotation.

The opposite ends of the stage ropes 30 may be connected to the work stage 16 by any appropriate cable stays or other means: for example, the stage ropes 30 and work stage 16 may be provided with cooperating chain links, or cooperating eyelets through which a bolt is received to maintain the eyelets in register with one another. Alternatively, the stage ropes 30 may double down to the work stage 16—in other words, the stage ropes 30 will extend from a hoist drum in the head frame 11, down to a sheave mounted to the work stage 16, pass around that sheave and back up to the head frame 11 where the stage ropes 30 will terminate. Such a 'doubling-down' arrange provides a mechanical advantage for the hoists by halving the force required to maintain the position of the work stage 16, or to lift and lower the work stage 16.

The stage support assembly 24 of the guide system 20 extends upwardly from the fixed guides 22. While the stage support assembly 24 is desirably flexible (i.e. extendable and retractable) so as to enable it to extend along with extension of the mineshaft 10, the length of the work stage 16 is relatively fixed so no such flexibility in the fixed guides 22 is necessary.

As personnel and materials are unloaded from the conveyance 18 when it is in the work stage 16, it is further desirable that the conveyance 18 be oriented consistently at loading/unloading points in the work stage 16. For this reason also, it is useful that the fixed guides are rigid and fixed in position relative to the work stage 16, particularly to enable consistent orientation of square or rectangular conveyances 18.

Figure 3:
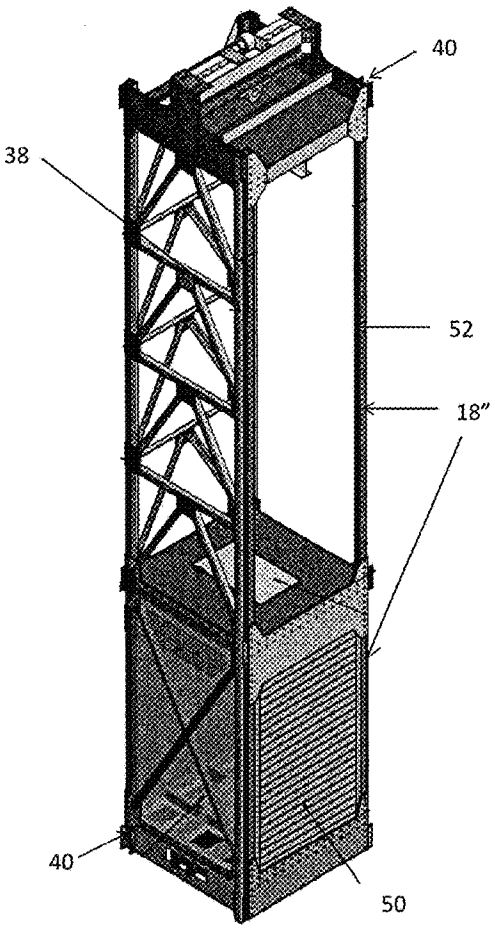
FIG. 3 is a side perspective view of a base section of the conveyance of FIG. 2 engaged with an intermediate section (fixed rails) of the guide system.

As shown in FIG. 3, the fixed guides 22 comprise a plurality of fixed rails 38 that are rigidly attached at various intervals to the work stage 16. The fixed rails 38 slide in channels 40 mounted to the conveyance 18, so that the conveyance 18, or at cage 18" thereof (discussed in further detail below), can advance through the work stage 16.

The channels 40 are necessarily open at one side to enable the cage 18" to slide past connections (not shown) between the fixed rails 38 and the work stage 16.

The fixed rails 38 extend a short distance above the connection between the stage ropes 30 and the work stage 16 so that guiding of the cage 18" on the fixed rails 38 commences before the stage ropes 30 cease guiding the conveyance 18. A slight overlap in guidance of the conveyance 18 by the stage ropes 30 and fixed rails 38 ensures that the orientation of the conveyance 18 is at all times controlled, thus enabling a conveyance 18 having a square cross-section to transition from one guide system to another where such transitioning would not be possible if the orientation of the conveyance 18 were uncertain.

While the stage ropes 30 may be connected directly to the fixed guides 22, the present stage ropes 30 are connected to the work stage 16 and the intermediate section 22 extends along a parallel, but not collinear, path as shown in FIG. 1. This is due to different guide means, namely sleeves 32 and channels 40, being the preferred guide means for use with the different types of section, namely the wire ropes or stage ropes 30 of the stage support assembly 24 and the fixed rails 38 of the fixed guides 22, respectively.

Figure 4:
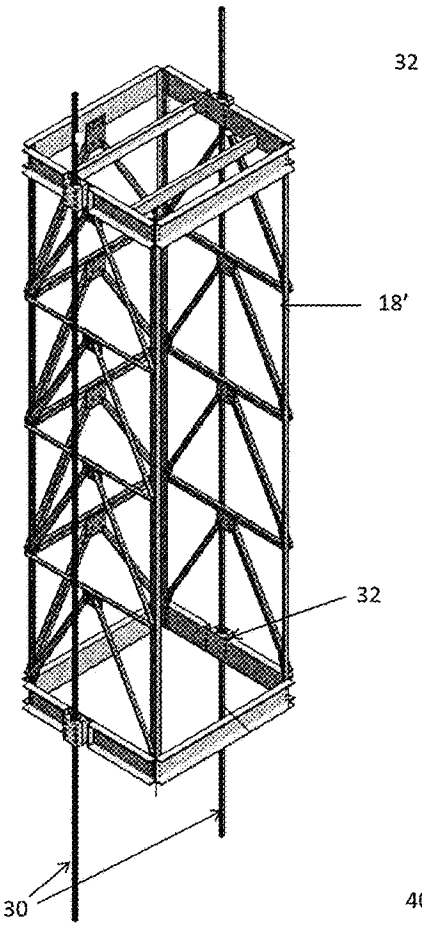
FIG. 4 is a side perspective view of a head section of the conveyance of FIG. 2 engaged with the upper guide section (stage ropes) of the guide system.

In addition, the conveyance 18 as shown in FIG. 2 comprises a head section, or crosshead 18' (see FIG. 4), and a base section, or auxiliary cage 18" (see FIG. 3). The head section 18' receives the cage 18" and assists with guiding the cage 18" along the stage support assembly 24 of the guide system 20, as shown in FIG. 2.

The cage 18" is used for the transportation of personnel (in lower cage 50), but can also be used for the transportation of goods (e.g. vent pipe 41 as shown in upper cage 52 in FIG. 2).

To transition between the stage support assembly 24 and the fixed guides 22 the crosshead 18' detaches from the cage 18". To facilitate this separation the stage support assembly 24 and fixed guides 22 meet at a transition region (not shown) where the crosshead 18' of the conveyance 18 separates from the cage 18".

The transition region comprises a chairing mechanism against which the crosshead 18' comes to rest during downward travel. Typically, when travelling downwardly along the stage support assembly 24 the conveyance 18 will slow, for example to a 'creep' speed, immediately before the chairing mechanism to reduce the impact of the crosshead 18' against the chairing mechanism. The chairing mechanism further includes a shock absorber to absorb impact loads from the head section 18' chairing against the work stage 16.

To facilitate movement from the stage ropes 30 onto the fixed rails 38, different guide devices are provided on the crosshead 18' and cage 18". On the one hand, sleeves 32 are provided on the crosshead 18' to enclose the stage ropes 30. The stage ropes 30 then pass through the sleeves 32 as the crosshead 18" travels along the stage ropes 30. On the other hand, the cage 18" is provided with channels 40 that receive the fixed rails 38 in the work stage 16 as the cage 18" progresses into the work stage 16, and permit the cage 18" to continue down the mineshaft 10 after the crosshead 18' has chaired against the ends of the stage support assembly 24.

Personnel in the work stage 16 line the mineshaft 10 during cutting of the mineshaft 10 by the cutting head 14. Thus the cutting head 14 advances downwardly to form the mineshaft 10, while the work stage 16 remains stationary to facilitate lining of the shaft 10. To this end the telescopic guide assembly 26 is extendable without a corresponding extension and/or retraction of the stage support assembly 24. Conversely, the telescopic guide assembly 26 retracts as the stage support assembly 24 extends since extension of the stage support assembly 24 results in lowering of the work stage 16 towards the cutting head 14 (i.e. the stage support assembly 24 extends with downward movements of the fixed guides 22).

The work stage 16 progresses downwardly in increments (e.g. 10.5 m increments). After each incremental movement, the work stage 16 is held stationary while the mineshaft 10 is lined with concrete: while the work stage 16 remains stationary the cutting head 14 advances to extend the mineshaft 10 as discussed above. In the embodiment shown in FIG. 1, the cutting head 14 may advance 10.5 m and then cease cutting, at which time the work stage 16 advances 10.5 m down the mineshaft 10 towards the cutting head 14 and lining of the next 10.5 m section of the mineshaft 10 can commence in the work stage 16.

Figure 5:
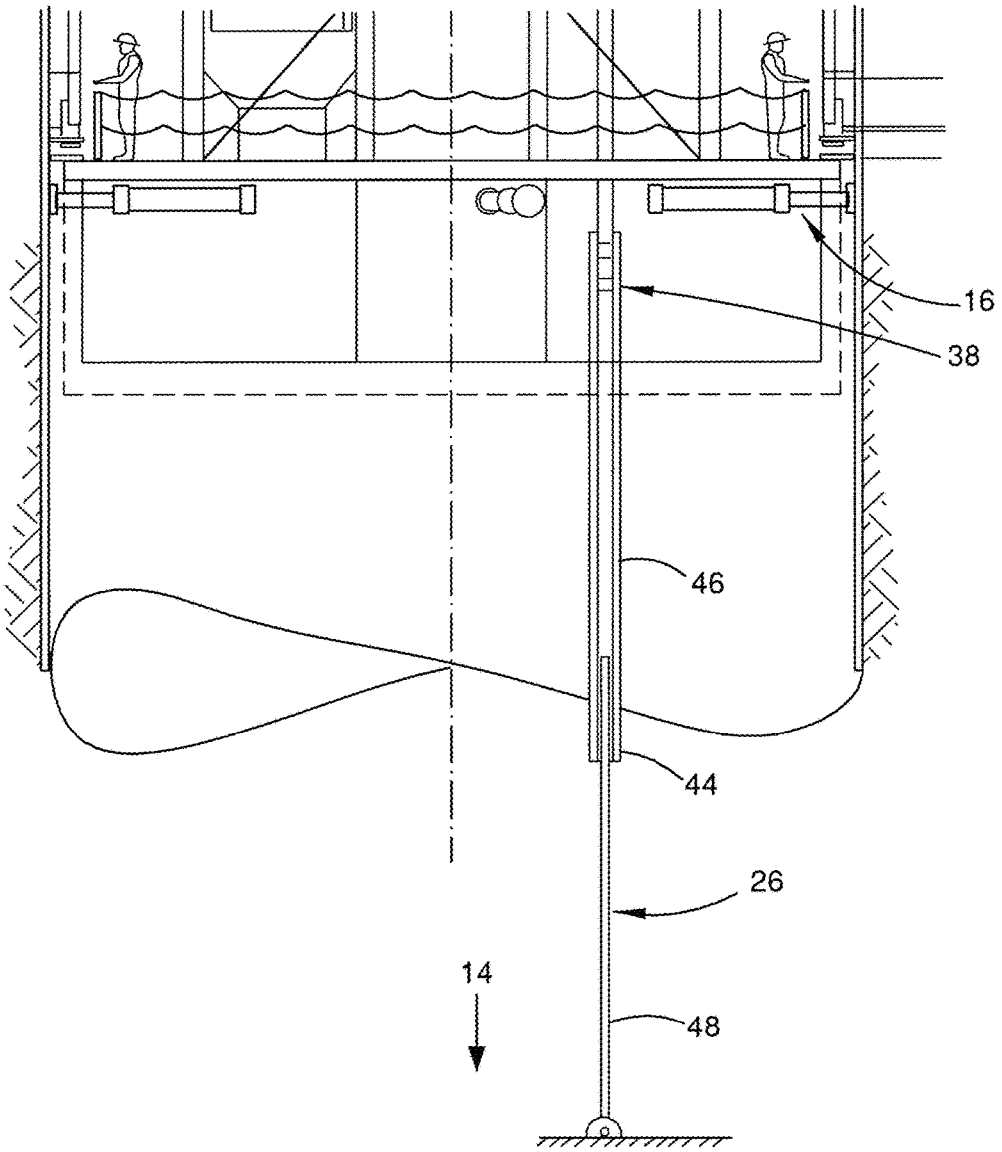
FIG. 5 is a side schematic view of a variable length guide system (telescopic guides).

The variable length lower guide section comprises a telescopic guide assembly 26. In the present embodiment, the telescopic guide assembly 26 comprises a plurality of telescopic guides 44 as shown in FIG. 5. Telescopic guides 44 enable the conveyance 18 to be guided along the space between the work stage 16 and shaft-boring machine 12, particularly where the work stage 16 has no mechanical connection with the shaft-boring machine 12. For example, the telescopic guides 44 can be adapted to extend from a work stage 16 that is suspended by stage ropes 30 (i.e. variable length upper guide section), down to a shaft-boring machine 12.

The telescopic guide assembly 26 extends downwardly from the fixed guides 22 to accommodate changes in distance between the fixed guides 22 and a lower region 42 of the mineshaft 10. The telescopic guide assembly 26 is in alignment with the fixed guides 22. In other words, the direction of extension of the telescopic guide assembly 26 is collinear with the longitudinal direction of the fixed guides 22. Thus the conveyance 18 can readily transition from the fixed guides 22 onto the telescopic guide assembly 26 and vice versa.

The telescopic guide assembly 26 constitutes a rigid, but variable length, guide along with the conveyance 18 travels below the work stage 16. Thus the conveyance 18 is guided below the work stage 16 in a manner that substantially prevents rotation and lateral movements of the conveyance 18.

If the conveyance 18 were instead to be hoisted without guidance, when moving in the region between the work stage 16 and excavator head, the conveyance 18 may swing outwardly and catch on the work stage 16 from below.

The telescopic guides 44 ensure there is always a guide extending the full distance between the work stage 16 and cutting head 14 so that a conveyance can be guided therebetween even as the distance changes. As mentioned above, the function of 'guiding' the conveyance 18 is distinct form the hoisting functions. The latter results in upward and downward movement of the conveyance 18. The former ensure the conveyance 18 remains on a particular path, in a particular orientation, during hoisting.

In traditional mines buckets are used during mucking to bring blasted rock from out of a mineshaft. The buckets are round and usually open topped. This is because the ropes on which the buckets descend allow the buckets to rotate. Consequently, the orientation of the buckets during filling/discharging of material cannot be guaranteed. By making the buckets round and open topped, the orientation of the buckets during filling/discharging does not matter. Also, buckets having square or rectangular cross-sections would hang-up against the walls of the shaft 10 or would catch on attempting to enter the work stage 16, if not properly guided.

As described above the orientation of the conveyance 18 can be critical in the present embodiment as there is limited space and the conveyance 18 must travel into the work stage 16. Thus rotation and/or lateral movements of the conveyance 18 are undesirable.

The variable length lower guide section provides a rigid, yet continuously extendable and retractable guide, between the work stage 16 and lower end 42 of the mineshaft 10. Thus the orientation of the conveyances 18 can be fixed, enabling the conveyances 18 to have a square, rectangular or other non-circular, cross-section. Fixing the orientation of the conveyance 18 makes the system safer as it removes uncontrolled rotation of the conveyance 18. Also, as personnel conveyances (e.g. lifts) typically have a square or rectangular cross-section, the variable length lower guide section 26 readily and safely accommodates use of such conveyances.

The telescopic guide assembly 26 as shown in FIG. 5 extends to a cutting head 14, and thus extends and retracts with changes in distance between the work stage 16 and cutting head 14.

The telescopic guide 44 of the telescopic guide assembly 26 comprises a first member, namely upper rail 46, and a second member, namely lower rail 48, that is slidably received in a lower end of the upper rail 46. The upper rail 46 is rigidly attached to the work stage 16, and the lower rail 48 is rigidly attached to the shaft-boring machine 12.

Each of the rails comprises a substantially square or rectangular steel tube, where the inner diameter of the outer rail (i.e. upper rail 46) is slightly larger than the outer diameter of the inner rail (i.e. lower rail 48). The rails 46, 48 are designed to have minimal tolerance so that there is little to no variance in the direction of extension of one rail 46, 48 relative to the other.

Extension and retraction of the telescopic guide assembly 24 may be directly driven (i.e. motorised) or may result from the movement of the shaft boring machine 12 away from the work stage 16, or conversely result from movement of the work stage 16 towards the shaft boring machine 12. In either case, with downward movement of the shaft boring machine 12, the lower rail 48 is drawn from within the concentrically disposed upper rail 46. Similarly, with downward movement of the work stage 16, the lower rail 48 is retracted into the concentrically disposed upper rail 46.

The upper rail 46 may also telescopically interact with a fixed rail 38 of the fixed guides 26. In particular, the lower end of the fixed rail 38 shown in FIG. 5 is received in the upper end of the upper rail 46. As the cutting head 14 advances downwardly, away from the work stage 16, the lower rail 48 is extended from the upper rail 46. Conversely, as the work stage 16 advances towards the cutting head 14 the lower rail 48 retracts into the upper rail 46.

Since the larger of any two concentrically disposed rails will present an edge against which the channel 40 of the conveyance 18 may snag during raising or lowering (depending on whether the larger diameter rail is the upper or lower rail of the two concentrically disposed rails), the channels 40 are flared on their upper and lower ends.

It will be appreciated that the telescopic guide assembly may comprise any number of concentrically disposed rails. For example, the telescopic guide 44 may comprise only a single rail (e.g. upper rail 46) that receives the fixed rail 38 attached to the work stage 16. As such the fixed rail 38 and upper rail 46 together would form a telescopic guide system 44. In other words, the telescopic guide assembly may comprise any number of rails including: two rails comprising the upper rail 46 and fixed rails 38; three rails comprising the lower rails 48, upper rail 46 and fixed rail 38; or four or more rails.

It will also be appreciated that the upper rail 46 may in fact retract up the fixed rail 38 as the work stage 16 advances, and extend from the fixed rail 38 as the cutting head advances provided that there are no connections between the fixed rail 38 and work stage 16 for a sufficient length at the lower end of the fixed rail 38.

The telescopic guide assembly 26 is only connected at its upper and lower ends. In particular, the telescopic guide assembly 26 is connected at its upper end to the work stage 16 and, at its lower end, to the shaft-boring machine 12. The telescopic guide assembly 26 is unsupported laterally between its ends.

Alternatively, the telescopic guide assembly 26 may be provided with a support extending from the back of the guide assembly 26 (i.e. from the side of the guide assembly 26 opposite the side along which the channels 40 of the conveyance 12 slide). The support may comprise one or more guide shoes. The guide shoes may be extendable and retractable to maintain contact with the wall of the mineshaft 10, since that wall may be rough.

The variable length lower guide system may alternatively comprise a rope and counterweight arrangement. As per the stage ropes 30, ropes extending between the work stage 16 and the shaft-boring machine 12 would pass around sheaves mounted in the work stage 16. Tension can be maintained in the ropes using a counterweight system so that the ropes are substantially rigid and thereby substantially prevent lateral movements and rotation of the conveyance 18 in the region below the work stage 16.

The ropes may extend from the work stage 16 down to a sheave mounted on the shaft-forming apparatus, around the sheave and back up to the work stage 16. Where the ropes extend from a hoist drum at the work stage 16, the hoist drum may be driven to extend and retract the ropes, and to maintain tension on the ropes such that they form substantially rigid guides along which the conveyance travels below the work stage 16. Alternatively, one end of each rope may be secured to the work stage 16, with the rope passing around a sheave mounted to the shaft-forming apparatus, back up and around a further sheave mounted to the work stage 16, and have the opposite end of each rope secured to a counterweight for maintaining proper tension in the rope.

The variable length lower guide section may constitute a system supplied entirely separately from the complete guide system 20 described above, and be designed for fitting to an existing shaft-boring system.

The invention claimed is:

1. A variable length guide system for guiding a conveyance along a mineshaft, the variable length guide system extending downwardly from a work stage and being extendable or retractable to accommodate changes in distance between the work stage and a lower region of a mineshaft;

wherein a fixed guide system extends into the work stage, upwardly from the variable length guide system, and the variable length guide system is in alignment with the fixed guide system.

2. A variable length guide system according to claim 1, wherein the variable length guide system extends from the work stage in the direction of a shaft forming apparatus.

3. A variable length guide system according to claim 2, wherein the variable length guide system extends to the shaft forming apparatus.

4. A variable length guide system according to claim 2, wherein the variable length guide system extends with movements of the shaft forming apparatus away from the work stage, and retracts with movements of the work stage towards the shaft forming apparatus.

5. A variable length guide system according to claim 2, further comprising a first member attached to the work stage and a second member attached to the shaft forming apparatus, wherein the first member and second member are slidably engaged and wherein relative sliding movement of the second member relative to the first member results in extension and retraction of the variable length guide system.

6. A variable length guide system according to claim 5, wherein downward movement of the shaft forming apparatus slidably extends the second member from the first member.

7. A variable length guide system according to claim 5, wherein downward movement of the work stage slidably retracts the second member into the first member.

8. A variable length guide system according claim 1, further comprising a telescopic guide assembly.

9. A variable length guide system according to claim 8, wherein the telescopic guide assembly comprises a plurality of concentrically disposed rails.

10. A variable length guide system according to claim 2, further comprising a normally flexible member extending between the work stage and shaft forming apparatus, the normally flexible member being held under sufficient tension to provide a substantially rigid guide along which the conveyance travels between the work stage and lower region.

11. A variable length guide system according to claim 10, wherein the normally flexible member comprises a rope.

12. A variable length guide system according to claim 10, wherein the normally flexible member comprises a cable.

13. A variable length guide system according to claim 10, wherein the normally flexible member is wound onto a drum and is held under tension by rotation of the drum.

14. A variable length guide system according to claim 10, wherein the normally flexible member is attached to one of the work stage and shaft forming apparatus, extends towards the other of the work stage and shaft forming apparatus, passes around a sheave and terminates at a counterweight for maintaining tension in the normally flexible member.

15. A variable length guide system according to claim 1, rigidly extending in fixed direction downwardly from the work stage.

16. A variable length guide system according to claim 15, being sufficiently rigid so as to substantially resist rotation and lateral movement of the conveyance during travel along the variable length guide system.

17. A variable length guide system according to claim 1, adapted to slidably engage the fixed guide system and to telescopically interact with the fixed guide system.

18. A variable length guide system according to claim 17, adapted to receive a lower end of the fixed guide system.

19. A variable length guide system according to claim 18, wherein when the variable length guide system retracts, the lower end of the fixed guide system retracts into the upper end of the variable length guide system.

* * * * *